United States Patent [19]

Hessel et al.

[11] Patent Number: 4,908,150

[45] Date of Patent: Mar. 13, 1990

[54] STABILIZED LIPOLYTIC ENZYME-CONTAINING LIQUID DETERGENT COMPOSITION

[75] Inventors: John F. Hessel, Metuchen; Martin S. Cardinali, Millington, both of N.J.; Michael P. Aronson, West Nyack, N.Y.

[73] Assignee: Lever Brothers Company, New York, N.Y.

[21] Appl. No.: 305,878

[22] Filed: Feb. 2, 1989

[51] Int. Cl.[4] ..... C11D 3/37; C11D 3/386

[52] U.S. Cl. ..... 252/174.12; 252/174.23; 252/174.24; 252/DIG. 2; 252/DIG. 12; 252/DIG. 14

[58] Field of Search ..... 252/174.12, 174.23, 252/174.24, DIG. 2, DIG. 12, DIG. 14, 548

[56] References Cited

U.S. PATENT DOCUMENTS

| | | | |
|---|---|---|---|
| 3,944,470 | 3/1976 | Diehl | 195/63 |
| 3,950,277 | 4/1976 | Stewart | 252/541 |
| 4,011,169 | 3/1977 | Diehl | 252/95 |
| 4,272,396 | 6/1981 | Fukano | 252/174 |
| 4,597,898 | 7/1986 | Vander Meer | 252/529 |
| 4,661,287 | 4/1987 | Crossin | 252/542 |
| 4,711,739 | 12/1987 | Kandathil | 252/139 |
| 4,715,990 | 12/1987 | Crossin | 252/551 |
| 4,746,456 | 5/1988 | Kud et al. | 252/174.24 |
| 4,751,008 | 6/1988 | Crossin | 252/8.8 |

FOREIGN PATENT DOCUMENTS 0258068 3/1988 European Pat. Off. .

*Primary Examiner*—Prince E. Willis

*Attorney, Agent, or Firm*—James J. Farrell

[57] ABSTRACT

The present invention relates to isotropic enzymatic liquid detergent compositions comprising lipolytic enzymes. The stability of the lipolytic enzymes is significantly improved therein by inclusion of particular nonionic ethylene glycol containing copolymers therein. These polymers comprise ethylene oxide or ethylene glycol, copolymerized with difunctional acids or acrylic based copolymers. Isotropic liquids are obtained without the aid of hydrocarbon solvents.

The compositions preferably also contain proteolytic enzymes.

11 Claims, No Drawings

STABILIZED LIPOLYTIC ENZYME-CONTAINING LIQUID DETERGENT COMPOSITION

BACKGROUND OF THE INVENTION

1. Field of the Invention

The present invention relates to enzymatic liquid detergent compositions comprising lipolytic enzymes and a nonionic polymeric stabilizing agent for the lipolytic enzymes.

2. Description of the Related Art

Enzymatic liquid detergent compositions are well-known in the art. Most of the prior proposals are however concerned with enzymatic liquid detergent compositions which contain a proteolytic enzyme ingredient, or a mixture thereof with amylolytic enzymes.

One of the problems, inherent to the use of enzymes in liquid detergent compositions is their stability in such liquid detergent compositions. The art is crowded with a variety of proposals to improve the stability of enzymes, particularly proteolytic and/or amylolytic enzymes in liquid detergent compositions.

In U.S. Pat. No. 4,715,990 (Crossin), enzymatic liquid detergent compositions are described which comprise a proteolytic and/or an amylolytic enzyme and a salt of a lower carboxylic acid such as sodium format as stabilizer for these enzymes. The compositions furthermore comprise a soil-release promoting polymer which is a water-soluble or water-dispersible polymer of polyethylene terephthalate or polyoxyethylene terephthalate.

Lipolytic enzymes have also been proposed for inclusion in liquid detergent compositions, although to a much lesser extent than proteases and/or amylases.

In U.S. Pat. No. 3,950,277 (Stewart et al), lipolytic enzymes are described in a pre-soaking composition for fabrics, whereby the pre-soaking composition also contains a lipase activator which can be a polyoxyethylene derivative of ethylenediamine.

In U.S. Pat. No. 3,944,470 (Diehl et al.) and U.S. Pat. No. 4,011,169 (Diehl et al.) certain aminated polysaccharides are proposed as enzyme-stabilizing agent, i.e. for lipolytic enzymes.

In U.S. Pat. No. 4,272,396 (Fukano et al.), enzymatic detergent compositions which may comprise lipase are described, which compositions also contain certain polyethyleneglycols as foam control agents.

In U.S. Pat. No. 4,711,739 (Kandathil), water-in-oil emulsion-type prespotter laundry compositions are described which may contain lipolytic enzymes and certain water-insoluble polyester or polyether polyols as enzyme stabilization agents. These compositions also contain a substantial amount of hydrocarbon solvents.

It is an object of the present invention to stabilise lipolytic enzymes with particular nonionic polymers in liquid detergent compositions. It is another object of the present invention to stabilize mixtures of lipolytic and proteolytic enzymes with particular nonionic polymers in liquid detergent compositions. A final objective of this invention are isotropic liquid detergent compositions containing a stable lipase, alone or in combination with protease, and containing the particular nonionic polymers dissolved therein without the aid of hydrocarbon solvents.

SUMMARY OF THE INVENTION

It has now been found that the above objectives can be achieved to a significant extent by the use of particular nonionic polymers composed of ethylene glycol or ethylene oxide copolymerized with certain types of hydrophobic monomers. These hydrophobic monomers are difunctional carboxylic acids such as adipic acid, terephthalic acid, and the like or are acrylic based monomers such as vinyl acetate. The polymers should dissolve in the compositions at room temperature but have preferably cloud point below 80° C. at 1% in aqueous solution. In contrast to the polymers disclosed in U.S. Pat. No. 4,711,739, which must be water-insoluble and possess an acid number below 1.0 mg to be useful in water-in-oil emulsions containing substantial hydrocarbon solvent, the present polymers must dissolve in the compositions without the aid of a hydrocarbon solvent and can have an acid number well in excess of this value. In fact, some of the most effective polymers have acid numbers as high as 3.3 mg. Since the stabilization of enzymes according to U.S. Pat. No. 4,711,739 is believed to be immobilization on the insoluble polymer, it was unexpected that the above nonionic polymers with higher acid numbers would improve the storage stability of lipolytic enzymes.

DETAILED DESCRIPTION OF THE INVENTION

The nonionic polymer of the invention is comprised of ethylene glycol or ethylene oxide copolymerized with one or more hydrophobic type comonomers. Preferred copolymers are polyesters of ethylene glycol with a hydrophobic comonomer such as adipic acid, terephthalic acid and the like, and copolymers of ethylene oxide with vinylacetate. The copolymers can be of the predominantly linear block or random type or can also be graft copolymers with pendant side chains. The average molecular weight ranges from about 3,000 to about 1,000,000. These copolymers are known per se e.g. from U.S. Pat. No. 4,715,990; U.S. Pat. No. 3,959,230 and European Patent 219,048 which describe suitable examples. The polymers must however be soluble in the final isotropic composition.

One particularly suitable class of polymers are copolymers of alkyl, aryl, or alkylaryl dicarboxylic acids with ethylene glycol or ethylene oxide. These include: adipic acid, sebacic acid, dodecanedioic acid, terephthalic acid and the like. A few examples of polymers within this general class are:

(i) Hoechst PE/88/2W-copolymer of adipic acid and ethylene glycol substituted with alkyl amine having the following structure:

$$-[OC(CH_2)_4CO]_y-[OCH_2CH_2]_x-\underset{\underset{R}{|}}{N}-[CH_2CH_2O]_z-$$

where $R = C_{16}$–$C_{18}$ hydrocarbon, where y is about 1 to about 500 and preferably about 10; where the sm of $x+z$ is about 40 to 14,000 and preferably about 300 and where the value of the fraction $$\frac{x+z}{y}$$

is about 5 to about 100 and preferably about 30. This specific polymer preferably has a molecular weight of about 22,000. The values of x, y and z are selected to insure that the polymer is soluble in the isotropic composition of the invention.

(ii) Alkaril QCJ-copolymer of ethylene glycol and terephthalic acid having the following structure:

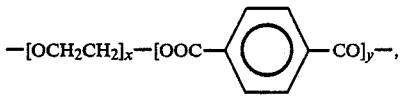

where x is about 30 to about 11,000 and preferably about 220; where y is about 1 to about 500 and preferably 10; where the value of the fraction x/y is about 5 to about 100 and preferably about 22. The molecular weight of this example of polymer is preferably about 20,000. As in the example above the values of x and y are selected to insure solubility of the polymer in the final isotropic detergent composition.

A second class of polymers found to be effective are polymers of ethylene glycol or ethylene oxide copolymerized with vinylic monomers such as vinyl acetate and the like. An example of this type of polymer is Copolymer HP22 sold by BASF. Its struture is:

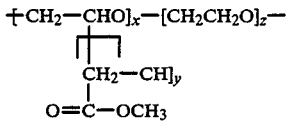

where y has a value of about 25 to about 9,000 preferably about 210; where the sum of x+z is about 15 to about 6,000 and preferably about 136 and where the value of the fraction $$\frac{x+z}{y}$$

is about 0.1 to about 10 and preferably about 0.65. The preferred molecular weight of this polymer is about 24,000. As above the values of x, y and z are selected to insure the polymer is soluble in the final isotropic composition.

It is understood that these monomers can be appropriately substituted to alter their solubility as desired. Also, other comonomers such as propylene oxide or butylene oxide can be employed in small amounts.

Thus, the ethylene glycol or ethylene oxide containing polymers useful in the present invention can be represented by the following general structure:

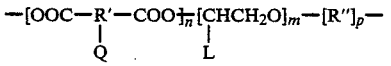

where R′ is a saturated, unsaturated, or aromatic hydrocarbon of 2–18 carbon atoms, preferably 4–12, R″ is selected from the group: propylene glycol, butylene glycol, an extended ethoxylate such as a multifunctional fatty amine ethoxylate, polyethylene glycol ether of glycerol esters or fatty ethanolamides and the like, Q and L are independently selected from the group consisting of:

(i) hydrogen, alkyl, alkylaryl, alkoxy, and alkylamine groups containing 1 to 20 carbon atoms, and (ii) hydrophobic vinylic based grafts such as vinyl acetate.

n must have a value at least one and preferably greater than five and m and p can be any integer including zero, the latter only when y is not hydrogen. However, the sum of m, n, and p are chosen such that the resulting polymer has a cloud point below 80° C. but is soluble in the final isotropic detergent composition.

In general, the nonionic polymer is incorporated in the compositions of the invention in an amount of abt. 0.1 to 10% by weight, preferably from 0.25–2% by weight.

The lipolytic enzyme used in the present invention is either a fungal lipase producible by *Humicola lanuginosa* and *Thermomyces lanuginosus,* or a bacterial lipase which show a positive immunological cross-reaction with the antibody of the lipase produced by the micro-organism *Chromobacter viscosum* var. lipolyticum NRRL B-3673. This micro-organisms has been described in Dutch patent specification 154 269 of Toyo Jozo Kabushiki Kaisha and has been deposited with the Fermentation Research Institute, Agency of Industrial Science and Technology, Ministry of International Trade & Industry, Tokyo, Japan, and added to the permanent collection under nr. Ko Hatsu Ken Kin Ki 137 and is available to the public at the United States Department of Agriculture, Agricultural Research Service, Northern Utilization and Development Division at Peoria, Ill., USA, under the nr. NRRL B-3673. The lipase produced by this micro-organism is commercially available from Toyo Jozo Co, Tagata, Japan, hereafter referred to as "TJ lipase". These bacterial lipases of the present invention should show a positive immunological cross-reaction with the TJ lipase antibody, using the standard and well-known immunodiffusion procedure according to Ouchterlony (Acta. Med. Scan., 133, pages 76–79 (1950).

The preparation of the antiserum is carried out as follows:

Equal volumes of 0.1 mg/ml antigen and of Freund's adjuvant (complete or incomplete) are mixed until an emulsion is obtained. Two female rabbits are injected with 2 ml samples of the emulsion according to the following scheme:

day 0: antigen in complete Freund's adjuvant
day 4: antigen in complete Freund's adjuvant
day 32: antigen in incomplete Freund's adjuvant
day 60: booster of antigen in incomplete Freund's adjuvant The serum containing the required antibody is prepared by centrifugation of clotted blood, taken on day 67.

The titre of the anti-TJ-lipase antiserum is determined by the inspection of precipitation of serial dilutions of antigen and antiserum according to the Ouchterlony procedure. A $2^5$ dilution of antiserum was the dilution that still gave a visible precipitation with an antigen concentration of 0.1 mg/ml.

All bacterial lipases showing a positive immunological cross-reaction with the TJ-lipase antibody as hereabove described are lipases suitable in the present invention. Typical examples thereof are the lipase ex *Pseudomonas fluorescens* IAM 1057 available from Amano Pharmaceutical Co, Nagoya, Japan, under the tradename Amano-P lipase, the lipase ex *Pseudomonas fragi* FERM P 1339 (available under the trade-name Amano-B), the lipase ex *Pseudomonas nitroreducens* var. lipolyticum FERM P 1338, the lipase ex Pseudomonas sp. available under the trade name Amano CES, the lipase ex *Pseudomonas cepacia,* lipases ex *Chromobacter viscosum,* e.g. *Chromobacter viscosum* var. lipolyticum NRRL B-3673, commercially available from Toyo Jozo Co., Tagata, Japan; and further *Chromobacter viscosum* lipases from US Biochemical Corp., USA and Diosynth Co., The Netherlands, and lipases ex *Pseudomonas gladioli.*

An example of a fungal lipase as defined above is the lipase ex *Humicola lanuginosa,* available from Amano under the trade-name Amano CE; the lipase ex *Humicola lanuginosa* as described in the aforesaid European Patent Application 0258,068 (NOVO), as well as the lipase obtained by cloning the gene from *Humicola lanuginosa* and expressing this gene in *Aspergillus oryzae,* commercially available from NOVO Industri A/S under the trade name "Lipolase". This Lipolase is a preferred lipase for use in the present invention.

The lipases of the present invention are included in the liquid detergent composition in such an amount that the final composition has a lipolytic enzyme activity of from 100 to 0.005 LU/mg, preferably 25 to 0.05 LU/mg of the composition.

A Lipase Unit (LU) is that amount of lipase which produces 1 μmol of titratable fatty acid per minute in a pH stat. under the following conditions: temperature 30° C.; pH=9.0; substrate is an emulsion of 3.3 wt.% of olive oil and 3.3% gum arabic, in the presence of 13 mmol $Ca^{2+}$ and 20 mmol/l NaCl in 5 mmol/l Tris-buffer.

Naturally, mixtures of the above lipases can be used. The lipases can be used in their non-purified form or in a purified form, e.g. purified with the aid of well-known adsorption methods, such as phenyl sepharose adsorption techniques.

Preferably, the compositions of the invention also comprise a proteolytic enzyme. Indeed it has been found that one of the benefits found for the polymers of the present invention is that they can stabilize lipase towards degradation by protease. The proteolytic enzyme, used in the present invention, can be of vegetable, animal or microorganism origin. Preferably it is of the latter origin, which includes yeasts, fungi, molds and bacteria. Particularly preferred are bacterial subtilisin type proteases, obtained from e.g. particular strains of *B. subtilis* and *B. licheniformis.* Examples of suitable commercially available proteases are Alcalase, Savinase, Esperase, all of NOVO Industri A/S; Maxatase and Maxacal of Gist-Brocades; Kazusase of Showa Denko; BPN and BPN' proteases and so on. The amount of proteolytic enzyme, included in the composition, ranges from 0.1–50 GU/mg, based on the final composition. Naturally, mixtures of different proteolytic enzymes may be used.

A GU is a glycine unit, which is the amount of proteolytic enzyme which under standard incubation conditions produces an amount of terminal $NH_2$-groups equivalent to 1 microgramme/ml of glycine.

The compositions of the invention furthermore comprise one or more detergent-active materials such as soaps, synthetic anionic, nonionic, amphoteric or zwitterionic detergent materials or mixtures thereof. These materials are all well-known in the art. Preferably the compositions contain a nonionic detergent or a mixture of a nonionic and an anionic detergent. Nonionic detergents are well-known in the art. They are normally reaction products of compounds having a hydrophobic group and a reactive hydrogen atom, for example aliphatic alcohols, acids, amides or alkylphenols with alkylene oxides, especially ethylene oxide either alone or with propylene oxide. Typical examples of suitable nonionic detergents are alkyl ($C_{6-22}$) phenol-ethylene oxide condensation products, with generally 5–25 moles of ethylene oxide per mole of alkylphenol, the condensation products of aliphatic $C_8$–$C_{18}$ primary or secondary, linear or branched chain alcohols with generally 5–40 moles of ethylene oxide, and products made by condensation of ethylene oxide and propylene oxide with ethylenediamine. Other nonionic detergents include the block copolymers of ethylene oxide and propylene oxide, alkylpolyglycosides, tertiary amine-oxides and dialkylsulphoxies. The condensation products of the alcohols with ethylene oxides are the preferred nonionic detergents.

Anionic detergents, suitable for inclusion in the compositions of the present invention include the $C_{10}$–$C_{24}$ alkylbenzenesulphonates, the $C_{10}$–$C_{18}$ alkanesulphonates, the $C_{10}$–$C_{24}$ alkylethersulphates with 1–10 moles of ethylene and/or propyleneoxide in the ether variety and so on.

In general, the compositions may contain the detergent-active compounds in an amount of 5–35% by weight.

The liquid detergent compositions of the present invention can furthermore contain one or more other, optional ingredients. Such optional ingredients are e.g. perfumes, including deoperfumes, colouring materials, opacifiers, soil-suspending agents, soil-release agents, solvents such as ethanol, ethyleneglycol, propylene glycol, hydrotropes such as sodium cumene-, toluene- and xylenesulphonate as well as urea, alkaline materials such as mono-, di- or triethanol-amine, clays, fabric-softening agents and so on. The liquid detergent composition may be unbuilt or built. If a built liquid detergent composition is required, the composition may contain from 1–60%, preferably 5–30% by weight of one or more organic and/or inorganic builder. Typical examples of such builders are the alkalimetal ortho-, pyro- and trip-polyphosphates, alkalimetal carbonates, either alone or in admixture with calcite, alkalimetal citrates, alkalimetal nitrilotriacetates, carboxymethyloxy succinates, zeolites, polyacetal carboxylates, oxidisuccinate, and other ether carboxylates and so on.

The compositions may furthermore comprise lather boosters, foam depressors such as silicones, anti-corrosion agents, chelating agents, anti-soil redeposition agents, bleaching agents, other stabilizing agents for the enzymes such as glycerol, sodium formate, calcium salts and the like, activators for the bleaching agents and so on. They may also comprise enzymes other than the proteases and lipases, such as amylases, oxidases and cellulases. In general, the compositions may comprise such other enzymes in an amount of 0.01–10% by weight.

The balance of the formulation consists of an aqueous medium.

The invention will further be illustrated by way of Example.

EXAMPLE I

The stability of Lipolase in the formulation given below was determined by measuring the lipase activity, using the pH-stat method as a function of time of storage at 37° C. The half-life time was determined by plotting ln [Ao/At] vs. time, where Ao=initial activity and At=activity at time t, and performing a linear regression.

The formulation was as follows:

| | composition (wt %) | |
|---|---|---|
| | 1.1 | 1.2 |
| sodium linear dodecylbenzene sulphonate | 10.0 | 10.0 |
| $C_{12}$–$C_{15}$ linear primary alcohol, condensed with 9 moles of ethylene oxide | 8.0 | 8.0 |
| sodium salt of sulphated $C_{12}$–$C_{15}$ linear primary alcohol, condensed with 3 moles of ethylene oxide | 6.0 | 6.0 |
| sodium xylenesulphonate | 3.0 | 3.0 |
| citric acid | 7.0 | 7.0 |
| borax | 2.7 | 2.7 |
| triethanolamine | 2.0 | 2.0 |
| monoethanolamine | 2.0 | 2.0 |
| stearic acid | 0.08 | 0.08 |
| sodium hydroxide | to neutralize to pH = 7 | |
| Lipolase | 3.0 | 3.0 |
| water | to 100% | to 100% |
| polymer* | 2.0 | — |

*The polymer was a polyester of adipic acid and ethyleneglycol with pendant fatty amine chains, available from Hoechst under the code PE/88/2W having a molecular weight believed to be about 22,000 and having the structure $$-[CO(CH_2)_4CO]_y-[OCH_2CH_2]_x-\underset{\underset{R}{|}}{N}-[CH_2CH_2O]_p$$ where y is 10, x + z is 300 and $\frac{x+z}{y}$ is 30, and R is a $C_{16}$–$C_{18}$ hydrocarbon.

The half-life time of the Lipolase was 17.0 days in 1.1, and 12.2 days in 1.2.

EXAMPLE II

The following formulations were prepared and evaluated for lipase activity at 37° C. as in Example I.

| | composition (wt. %) | | |
|---|---|---|---|
| | 2.1 | 2.2 | 2.3 |
| $C_{12}$–$C_{15}$ linear primary alcohol, condensed with 9 moles of ethylene oxide | 16.5 | 16.5 | 16.5 |
| sodium $C_{11}$-alkylbenzene sulphonate | 3.5 | 3.5 | 3.5 |
| ethanol | 5.0 | 5.0 | 5.0 |
| sodium formate | 2.7 | 2.7 | 2.7 |
| Alcalase 2.5 L (protease ex NOVO) | 0.75 | 0.75 | 0.75 |
| Lipolase | 3.0 | 3.0 | 3.0 |
| water | to 100% | to 100% | to 100% |
| polymer* | — | 2.0 | — |
| polymer** | — | — | 1.0 |

*this polymer was the same as in Example I.

**this polymer was a copolymer of ethyleneglycol and terephthalic acid as described in U.S. Pat. No. 3,959,230, having a molecular weight of about 20,000 and the structure

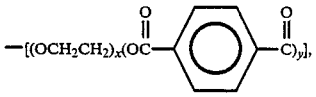

where x is 220 and y is 10, available under the trade name Alkaril QCJ.

The half-time of Lipolase in these formulations was: 1.7 days in 2.1; 8.8 days in 2.2 and 41.0 days in 2.3.

EXAMPLE III

The following compositions were prepared and evaluated for lipase stability at 37° C.

| | composition (wt %) | |
|---|---|---|
| | 3.1 | 3.2 |
| $C_{12}$–$C_{15}$ linear primary alcohol, condensed with 9 moles of ethylene oxide | 16.5 | 16.5 |
| ethanol | 4.9 | 4.9 |
| sodium formate | 2.7 | 2.7 |
| Savinase (a protease ex NOVO) | 0.375 | 0.375 |
| Lipolase | 3.0 | 3.0 |
| polymer* | — | 1.0 |
| water | to 100% | to 100% |
| The half life time of Lipolase was (at 37° C.): | 16.0 | 47.7 |

*The polymer was a copolymer of ethyleneglycol with pendant vinylacetate side chains having a molecular weight of about 24,000 as described in European Patent 219,048. The polymer is available from BASF under the code HP22 and has the structure $[-CH_2CHO-]_x-[CH_2CH_2O]_z$ where y is about 210;

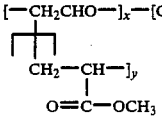

x + z is about 136 and $\frac{x+z}{y}$ is about 0.65.

EXAMPLE IV

A series of representative water soluble polymers that are not polymers of ethylene glycol were evaluated. The liquid detergent composition of this example was identical with that of Example II. Each of the polymers was tested at 2.0% in this composition for improving lipase stability. The results are presented below.

| | Composition (wt. %) | | | | |
|---|---|---|---|---|---|
| Ingredients | 4.1 | 4.2 | 4.3 | 4.4 | 4.5 |
| Formulation of Example 2.1 | 100.0 | 98.0 | 98.0 | 98.0 | 98.0 |
| Polymer LR 400 ex Amerchol | 0.0 | 2.0 | 0.0 | 0.0 | 0.0 |
| Carteretin F4 ex Sandoz | 0.0 | 0.0 | 2.0 | 0.0 | 0.0 |
| Poly(vinyl alcohol) ex Gohsenol GH-20 | 0.0 | 0.0 | 0.0 | 2.0 | 0.0 |
| Poly(vinyl pyridine N-oxide) ex Polyscience | 0.0 | 0.0 | 0.0 | 0.0 | 2.0 |
| stability(at 37° C.):$t_{\frac{1}{2}}$ (days) | 1.7 | 1.3 | 1.6 | 1.5 | 1.8 |

Polymer LR 400 is an example of a cationic cellulose polymer that was shown in U.S. Pat. No. 4,011,169 to provide improved enzyme stability in buffer solutions, but was found to be ineffective when incorporated into a liquid detergent.

Carteretin F4 is a copolymer of adipic acid and dimethyl amino hydroxy propyl diethylene triamine of the following structure:

Polymer LR 400 is an example of a cationic cellulose polymer that was shown in U.S. Pat. No. 4,011,169 to provide improved enzyme stability in buffer solutions, but was found to be ineffective when incorporated into a liquid detergent. Carteretin F4 is a copolymer of adipic acid and dimethyl amino hydroxy propyl diethylene triamine of the following structure:

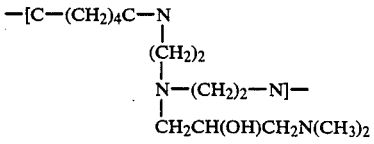

Carteretin F4 was found to have no effect on lipase stability at a concentration of 2.0 wt. %. Poly(vinyl alcohol) had no effect on lipase stability. Poly(vinyl pyridine-N-oxide), was found to have no effect on lipase stability.

EXAMPLE V

A series of nonionic copolymers of polyvinylpyrrolidone (PVP) with vinyl acetate (VA) or vinyl imidazoline (VI) were evaluated for lipase stabilizing properties. The detergent liquid composition was identical with that of Example II, 2.1. Each of the polymers was tested at 2.0% in this composition. The results are presented below:

| | Composition (wt. %) | | | |
|---|---|---|---|---|
| Ingredient | 5.1 | 5.2 | 5.3 | 5.4 |
| Formulation of Example 2.1 | 100.0 | 98.0 | 98.0 | 98.0 |
| PVP/VI = 10/90 | 0.0 | 2.0 | 0.0 | 0.0 |
| 50/50 | 0.0 | 0.0 | 2.0 | 0.0 |
| 30/70 | 0.0 | 0.0 | 0.0 | 2.0 |
| Stability $t_{\frac{1}{2}}$ (days) | 2.2 | 2.6 | 3.2 | 2.6 |

| | Composition (wt. %) | | | | |
|---|---|---|---|---|---|
| Ingredient | 5.5 | 5.6 | 5.7 | 5.8 | 5.9 |
| Formulation of Example 2.1 | 98.0 | 98.0 | 98.0 | 98.0 | 98.0 |
| PVP/VA = 100/0 | 2.0 | 0.0 | 0.0 | 0.0 | 0.0 |
| 70/30 | 0.0 | 2.0 | 0.0 | 0.0 | 0.0 |
| 60/40 | 0.0 | 0.0 | 2.0 | 0.0 | 0.0 |
| 50/50 | 0.0 | 0.0 | 0.0 | 2.0 | 0.0 |
| 30/70 | 0.0 | 0.0 | 0.0 | 0.0 | 2.0 |
| Stability: $t_{\frac{1}{2}}$ (days) | 2.3 | 3.2 | 3.1 | 2.8 | 2.7 |

None of the copolymers of either series was effective at stabilizing lipase in this composition.

What is claimed is:

1. An isotropic enzymatic liquid detergent composition comprising, in an aqueous liquid medium, from 0.005–100LU per milligramme of the final composition of a lipolytic enzyme selected from *Humicola lanuginosa* and *Thermomyces lanuginosus* and bacterial lipases which show a positive immunological cross-reaction with the antibody of the lipase, produced by *Chromobacter viscosum* var. lipolyticum NRRL B-3673, from 5–35% by weight of a detergent-active compound, and from 0.1–10% by weight of an ethylene glycol containing polymer with an average molecular weight of 3,000 to 1,000,000 having the following structure $$-[OOC-\underset{\underset{Q}{|}}{R'}-COO]_n[\underset{\underset{L}{|}}{CH}CH_2O]_m-[R'']_p-$$

where R′ is a saturated, unsaturated, or aromatic hydrocarbon of 2–18 carbon atoms, R″ is selected from the group consisting of propylene glycol, butylene glycol, fatty amine ethoxylate, polyethylene glycol ether of glycerol esters and fatty ethanolamides, Q and L are independently selected from the group consisting of:

(i) hydrogen, alkyl, alkylaryl, alkoxy, alkylamine groups containing 1 to 20 carbon atoms, and (ii) a vinyl acetate graft; where m has a value of at least one and n and p are any integer including zero, except n cannot be 0 when L is hydrogen, said polymer being soluble in said isotropic detergent composition.

2. The composition of claim 1, wherein m is greater than 5.

3. The composition of claim 1, wherein the sum of m, n and p is such that the polymer has a cloud point below 80° C. at a concentration of 1% by weight in aqueous solution.

4. The composition of claim 1, wherein the polymer is a copolymer of adipic acid and ethylene glycol substituted with alkyl amine having the following structure:

$$-[OC(CH_2)_4CO]_y-[OCH_2CH_2]_x-\underset{\underset{R}{|}}{N}-[CH_2CH_2O]_z-$$

where R is $C_{16}$–$C_{18}$ hydrocarbon, wherein y is about 1 to about 500; wherein the value of the sum of x+z is about 40 to about 14,000 and wherein the value of the fraction $$\frac{x+z}{y}$$

is about 5 to about 100.

5. The composition of claim 1, wherein the polymer is a copolymer of ethylene glycol and terephthalic acid having the following structure:

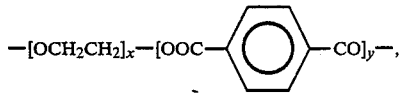

wherein x is about 30 to about 11,000; wherein y is about 1 to about 500 and wherein the value of the fraction x/y is about 5 to about 100.

6. The composition of claim 1, wherein the polymer is a copolymer of ethylene glycol with pendant vinyl acetate side chains having the structure

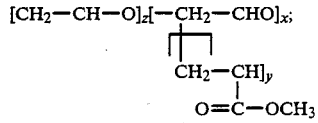

wherein y is about 25 to about 9,000; wherei the value of the sum of x+z is about 15 to about 6,000; and wherein the value of the fraction $$\frac{x+z}{y}$$

is about 0.1 to about 10.

7. The composition of claim 1, wherein the lipase is a lipase, obtained by cloning the gene from *Humicola lanuginosa* and expressing this gene in *Aspergillus oryzae.*

8. The composition of claim 1, further comprising a proteolytic enzyme in an amount of 0.1–50 GU per milligramme of the final composition.

9. The composition of claim 1, wherein the polymer is a copolymer of adipic acid and ethylene glycol substituted with alkyl amine having the following structure:

$$-[OC(CH_2)_4CO]_y-[OCH_2CH_2]_x-\underset{\underset{R}{|}}{N}-[CH_2CH_2O]_z-$$

where R is $C_{16}$–$C_{18}$ hydrocarbon, wherein y is about 10; wherein the value of the sum of x+y is about 300 and wherein the value of the fraction $$\frac{x+z}{y}$$

is about 30.

10. The composition of claim 1, wherein the polymer is a copolymer of ethylene glycol and terephthalic acid having the following structure:

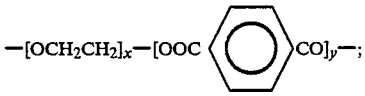

wherein x is about 220; wherein y is about 10 and wherein x/y is about 22.

11. The composition of claim 1, wherein the polymer is a copolymer of ethylene glycol with pendant vinyl acetate side chains having the structure

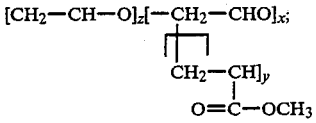

wherein y is about 210; wherein x+z is about 136 and wherein the value of the fraction $$\frac{x+z}{y}$$

is about 0.65.

* * * * *